US005644551A

United States Patent [19]

Carmichael et al.

[11] Patent Number: 5,644,551

[45] Date of Patent: Jul. 1, 1997

[54] ADAPTABLE ENGINE USAGE METER

[76] Inventors: Edward Carmichael, 4373 Sequoyah Rd., Oakland, Calif. 94605; Robert Legge, 1465 Kring Way, Los Altos Hills, Calif. 94024

[21] Appl. No.: 438,160

[22] Filed: May 9, 1995

[51] Int. Cl.[6] ..... G04F 8/00; F02P 17/00

[52] U.S. Cl. ..... 368/5; 368/6; 324/156; 324/402

[58] Field of Search ..... 368/3, 5, 6, 9, 368/10, 110–113; 324/129, 133, 156, 384, 402, 390–392

[56] References Cited

U.S. PATENT DOCUMENTS

| | | | |
|---|---|---|---|
| 1,611,568 | 12/1926 | Standow | 368/316 |
| 2,714,283 | 8/1955 | Gazda | 368/6 |
| 3,903,836 | 9/1975 | Kreidler | 368/316 |
| 4,887,249 | 12/1989 | Thinesen | 368/10 |
| 5,001,431 | 3/1991 | Garasimowicz et al. | 324/402 |
| 5,001,432 | 3/1991 | Wixon | 324/402 |
| 5,337,003 | 8/1994 | Carmichael et al. | 324/402 |

OTHER PUBLICATIONS

Brochure of model "ARM–126" engine hour log by Autonic Research, Inc.

Brochure of Running Time Meter by Computime, Inc.

*Primary Examiner*—Vit W. Miska

*Attorney, Agent, or Firm*—Jack Lo

[57] ABSTRACT

An adaptable engine usage meter includes engine monitoring circuitry arranged within a front housing. Three different rear housings can be interchangeably attached to the front housing. A first rear housing includes a concave back portion, so that in conjunction with a complementary concave mounting bracket, it allows the meter to be attached to a round handlebar, such as that on a push mower. A second rear housing is slightly narrower than the front housing, so that a shoulder is formed when they are attached together. The second rear housing allows the meter to be mounted on an instrument panel by fitting it through a cutout until the shoulder engages the panel. When either the first or second rear housing is used, the circuitry in the front housing is connected to the ignition wire and the ground of an engine via a cable extended through the rear housing. A third rear housing includes a combination sensor and mounting clip rigidly attached thereto, so that it allows the meter to be clipped and supported directly on the ignition wire. A ground wire extended through the third rear housing can be connected to a grounded portion of the engine. When installed, the engine usage meter accurately monitors engine usage and displays its total running time, so that regular engine maintenance can be performed according to schedule.

14 Claims, 4 Drawing Sheets

ADAPTABLE ENGINE USAGE METER

BACKGROUND OF THE INVENTION

1. Field of the Invention

This invention relates generally to combustion engine instrumentation, specifically to an engine usage meter for monitoring the actual operating time of spark ignition engines.

2. Prior Art

In many applications of the internal combustion engine, accurate monitoring of the engine's total operating time is vital. For example, aircraft engines and small engines that power portable equipment are maintained according to actual operating hours. Rental vehicles, boats, generators, construction equipment, or anything powered by combustion engines that are rented hourly, all require accurate and reliable accounting of the machines'operating times.

The maintenance of the small engines used in lawn mowers, chain saws, blowers, etc., are often neglected, because most of them lack operating time indicators, so that the users easily lose track of the engine's total operating hours. As a result, their oil and oil filters are used far beyond their useful lives, so that engine wear and harmful emissions are increased. More stringent EPA (Environmental Protection Agency) emission regulations that are now being anticipated will necessitate the regular maintenance of the small combustion engines used in portable equipment. The EPA will also be actively urging users of such engines to perform regular oil change and maintenance to prevent increased emissions.

Engine usage meters for monitoring total engine operating times have been available for many years. On older spark ignition engines, the monitoring device is usually an electromechanical hour counter, or Hobbs meter, mounted in an instrument panel, and powered by an external battery. The counter is triggered by the engagement of the ignition system. When the ignition system is turned on, the counter will being its timing operation; when the ignition is turned off, the counter will cease its timing operation. The elapsed time thus indicates the ignition system's operating time. The elapsed times of successive operations are added together to produce the accumulated or total operating time of the engine. Another common type of hour counter determines engine operating time by counting the number of spark impulses at a predetermined engine speed. All electromechanical hour counters must be connected to the engine's battery for power, and must be configured for specific engine parameters, such as the number of engine cylinders, the number of strokes, engine speed, etc. They cannot be used on hand-started engines without a battery, such as push mowers, chain saws, blowers, etc.

Autonnic Research International, Inc. in Hayward, Calif., manufactures the model "ARM-126" engine usage meter for spark ignition engines. It is self-contained in a single housing. An integral mounting and grounding tab extending therefrom is used for bolting the meter directly onto an electrically grounded engine block. The "ARM-126" is the first engine usage meter to be self-powered, so that it eliminates the need for cumbersome power hookups, and will maintain its data even when it is disconnected from the engine. It uses extremely low power CMOS (Complementary-Metal-Oxide Semiconductor) components and a long-life lithium battery. A capacitive sensor clip at the distal end of a flying signal wire extending from the housing can be clipped onto a spark plug wire or ignition wire for sensor electrical impulses therein. Because the self-powered "ARM-126" is mounted directly onto the engine, the signal wire is very short and easy to route. The "ARM-126" is heat resistant, and is tightly sealed to resist liquid intrusion and tampering.

A timer in the "ARM-126" is triggered by electrical impulses passing through the ignition wire, and will keep running for as long as the impulses continue. The elapsed time during which the impulses are present represents the engine's operating time. A LCD (Liquid Crystal Display) on the device displays the total accumulated engine operating time, in tenths of an hour, up to 19,999.9 hours. The "ARM-126" can be used on any type of spark ignition engine, regardless of the type of ignition system, the number of cylinders, the number of strokes, or engine speed. Therefore, it does not need to be adjusted or specially configured in any way. Because of the design and quality of its components, it has a known operating life that exceeds ten years, and a projected life of twenty years. It also has an accuracy of ±3 seconds per thousand hours of running time.

Our U.S. Pat. No. 5,337,003 (Aug. 9, 1994) discloses an engine usage meter with an integral sensor clip extending rigidly therefrom for clipping the entire unit directly onto an ignition wire, and a flying ground wire for attaching to any grounded part of the engine, vehicle, or equipment. It is electrically identical to the Autonnic Research International "ARM-126", and it is very easy to install.

The "Running Time Meter" made by Computime, Inc. of Denham Springs, La., was introduced after the "ARM-126" had become known. It is the only other self-powered engine usage meter on the market. However, its housing must be mounted some distance away from the heat and fuel lines of an engine, e.g., on an instrument panel or engine cover. Such an installation will require the cumbersome procedure of routing long lead wires through the engine compartment. Furthermore, it has a sensor wire which must be wrapped many turns around the ignition wire of the engine, the number of turns being dependent upon the length of the sensor wire, and largely determined by trial-and-error. As a result, its installation is difficult.

Each prior art engine usage meter is suitable for only a single type of installation, e.g., a meter designed for being mounted onto a panel cannot be mounted directly onto an ignition wire, and vice versa. No prior art engine usage meter can be mounted on the handlebar of a push mower, where it would be most easily readable. Therefore, each type of vehicle or equipment requires a usage meter that is specifically designed for it. A manufacturer who wishes to market a line of usage meters for different types of vehicles and equipment would have to make separate tooling for different models, and keep a separate stock of each model. However, such a practice would be very expensive.

OBJECTS OF THE INVENTION

Accordingly, several objects of the present invention are to provide an adaptable engine usage meter that can be easily adapted for being installed onto a great variety of different vehicles and equipment; that is very easy to install; that is self-powered, so that it can be used on hand-started engines without batteries; that is compact and lightweight; that can accurately monitor the actual operating time of an engine for the regular maintenance thereof; that can accurately monitor an engine regardless of its number of cylinders, strokes, or type of ignition system; that is heat, liquid, and tamper resistant; and that is economical to manufacture and stock. Other objects of the present invention will become apparent from a study of the following description and the accompanying drawings.

SUMMARY OF THE INVENTION

In a preferred embodiment of the invention, an adaptable engine usage meter includes a front housing that contains conventional engine monitoring circuitry and a display, and three different rear housings that can be interchangeably attached to the front housing. A first rear housing has a concave back portion for mounting around half of a round handlebar, such as that of a push mower. A separate Concave mounting frame can be positioned around the other half of the handlebar, and attached to the rear housing for securing the meter thereon. A cable is extended through the rear housing, and includes a signal wire with a capacitive sensor clip at a distal end thereof for connecting to the ignition wire of an engine, and a ground wire for connecting to a grounded portion of the engine.

A second rear housing is slightly narrower in width and height than the front housing, so that when they are attached together, a shoulder is formed therebetween. The second rear housing can be positioned through a cutout in an instrument panel until the shoulder is seated thereon. The same cable is extended through the second rear housing for connecting to the engine.

A third rear housing includes a combination sensor and mounting clip extending rigidly therefrom. When the third rear housing is attached to the front housing, the clip can be clipped onto an ignition wire of an engine for supporting the entire meter thereon. A ground wire is extended through the third rear housing for connecting to a grounded portion of the engine.

All the electronics are contained within the front housing; the rear housings contain no electronics, so that they are very inexpensive to manufacture. A single version of the front housing can thus be attached to one of the inexpensive rear housings for mounting on either a handle bar, an instrument panel, or directly onto an ignition wire. Accordingly, manufacturing and inventory costs of the engine usage meter are minimized.

DRAWING REFERENCE NUMERALS

| | |
|---|---|
| 10. Front Housing | 11. First Rear Housing |
| 12. Concave Mounting Bracket | 13. Liquid Crystal Display |
| 14. Cable | 15. Signal Wire |
| 16. Sensor Clip | 17. Ground Wire |
| 18. Grounding Lug | 19. Solder Pads |
| 20. Concave Back Portion | 21. Screws |
| 22. Screw Holes | 23. Screws |
| 24. Rim | 25. Groove |
| 26. Lens | 27. Integrated Circuit |
| 28. Printed Circuit Board | 29. Conductive Strip |
| 30. Spring Contact | 31. Second Rear Housing |
| 32. Shoulder | 33. Rim |
| 34. Instrument Panel | 35. Cutout |
| 36. Combination Sensor And Mounting Clip | 37. Sleeve |
| 38. Ground Wire | 39 Grounding Lug |
| 40. Ignition Wire | 41. Rim |
| 42. Conductive Screw | 43. Handlebar |
| 44. Solder Pads | 45. Solder Pads |
| 46. Locking Tabs | 47. Round Pin |
| 48. Tube | 49. Polygonal Bore |
| 50. Shoulder | 51. Recess |

DESCRIPTION—FIGS. 1A TO 1D—HANDLEBAR MOUNTING

Figure 1A:
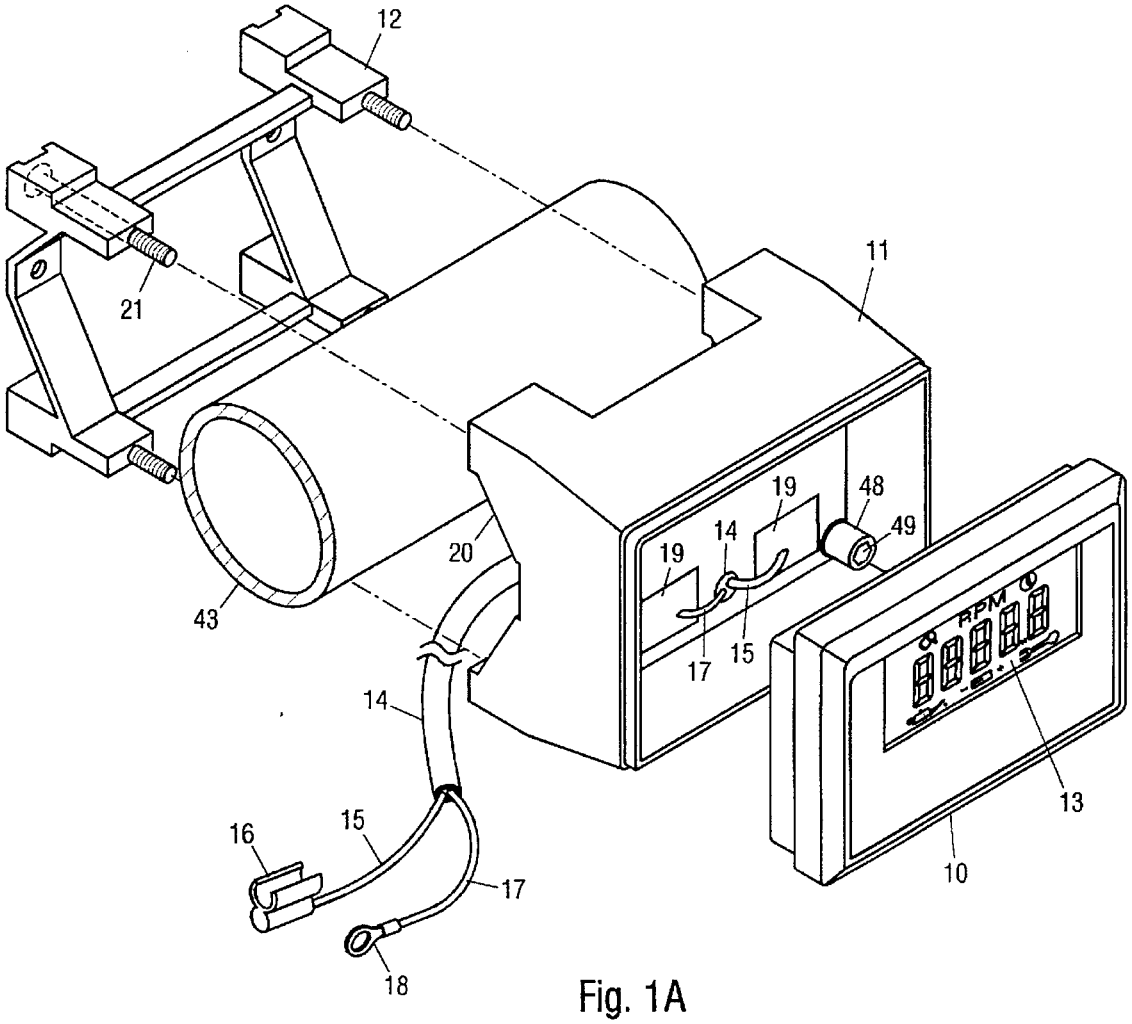
FIG. 1A is a front perspective exploded view of an engine usage meter for mounting on a handlebar in accordance with the invention.

In accordance with the invention shown in the front perspective exploded view in FIG. 1A, an adaptable engine usage meter generally includes a front housing 10, a first rear housing 11, and a Concave mounting bracket 12. An LCD (liquid crystal display) 13 is mounted on the front face of front housing 10 for displaying a variety of information, including total engine operating time. A cable 14 includes a signal wire 15 with a capacitive sensor clip 16 attached at the distal end thereof, and a ground wire 17 with a grounding lug 18 attached at the distal end thereof. Clip 16 is made of the same material as the clip disclosed in my U.S. Pat. No. 5,337,003, and performs the same electrical function.

The proximal end of cable 14 is extended through the back side of rear housing 11, and the proximal ends of wires 15 and 17 are soldered to a pair of solder pads 19 on the inside of rear housing 11. Rear housing 11 includes a pair of concave back portions 20 (one shown) for being positioned around half of a round handlebar 43, such as that on a push mower or chain saw (not shown). A tube 48 with a polygonal bore 49 is positioned at each corner inside rear housing 11. Concave mounting bracket 12 is positioned around the other half of handlebar 43. Four screws 21 are extended through the corners of mounting bracket 12 for screwing into corresponding corners of rear housing 11, so as to secure the engine usage meter around handlebar 43.

Figure 1B:
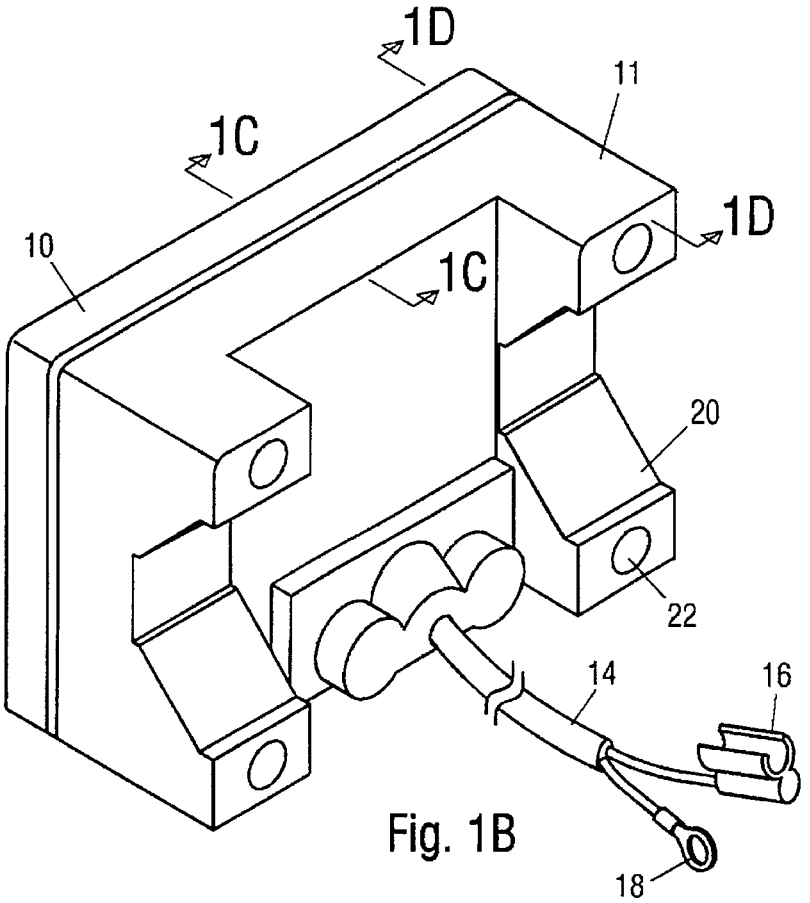
FIG. 1B is a rear perspective view of the engine usage meter of FIG. 1A partially assembled.

Front housing 10 and rear housing 11 are shown assembled in the rear view in FIG. 1B. A screw hole 22 is arranged at each end of concave portions 20 for receiving the ends of screws 21 (FIG. 1A). Clip 16 is adapted to be clipped onto an ignition wire of an engine (not shown), and grounding lug 18 is adapted to be bolted to a grounded portion of the engine. The present engine usage meter is electrically connected to an engine in the same way as the hour log disclosed in my U.S. Pat. No. 5,337,003.

Figure 1C:
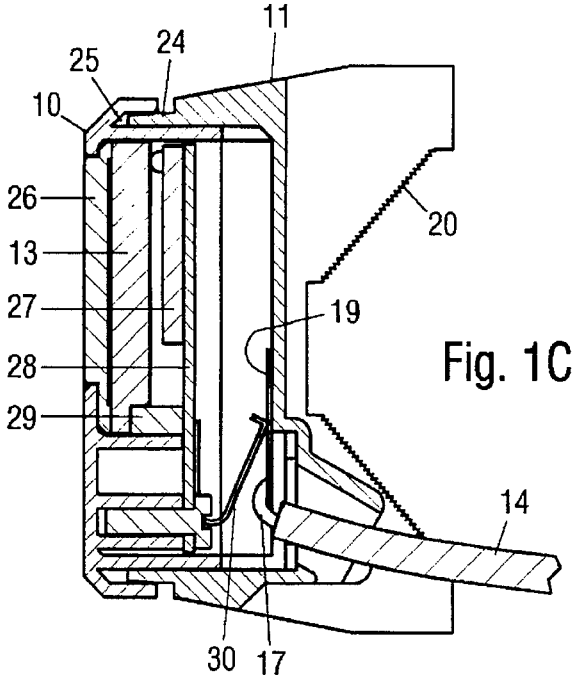
FIG. 1C is a side sectional view of the engine usage meter taken along line 1C—1C in FIG. 1B.

As shown in the side sectional view in FIG. 1C, a rim 24 of rear housing 11 is tightly fitted into a groove 25 surrounding the sides of front housing 10, so that the housings are securely attached together to form a water and tamper resistant assembly. A lens 26 mounted on the face of housing 10 covers LCD 13. An integrated circuit or IC 27 is mounted on a printed circuit board or PCB 28, which is connected to LCD 13 via a conductive strip 29. Each of a pair of V-shaped spring contacts 30 (one shown) has one side soldered to PCB 28, and another side urged against a corresponding solder pad 19 (FIG. 1A), so as to provide an electrical connection between PCB 28 and cable 14. A long-life battery (not shown) mounted within housing 10 provides internal power, so that the engine usage meter can be used for monitoring hand-started engines without batteries. Housings 10 and 11 are made of a heat resistant material.

Figure 1D:
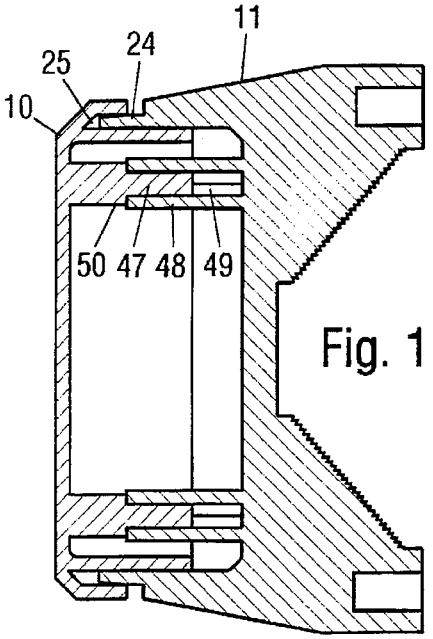
FIG. 1D is a side sectional view of the engine usage meter taken along line 1D—1D in FIG. 1B.

As shown in the side sectional view in FIG. 1D, a round pin 47 integral to front housing 10 is inserted into polygonal bore 49 of tube 48, until the distal end of tube 48 engages a shoulder 50 around the base of pin 47. Pin 47 is tightly fitted within bore 49, so that front housing 10 and rear housing 11 are fixedly attached together, and cannot be easily separated.

The circuitry used in the present engine usage meter is substantially the same as that in Autonnic Research International's model "ARM-126" engine hour log. Therefore, when the present engine usage meter is electrically connected to an engine (not shown), it will accurately monitor the engine's operation and display its total operating time on LCD 13, regardless of the engine's number of cylinders, strokes, or type of ignition system, and without requiring any adjustment. By displaying the engine's total operating time, regular maintenance can be performed according to the engine manufacturer's recommended schedule.

DESCRIPTION—FIGS. 2A TO 2C—PANEL MOUNTING

Figure 2A:
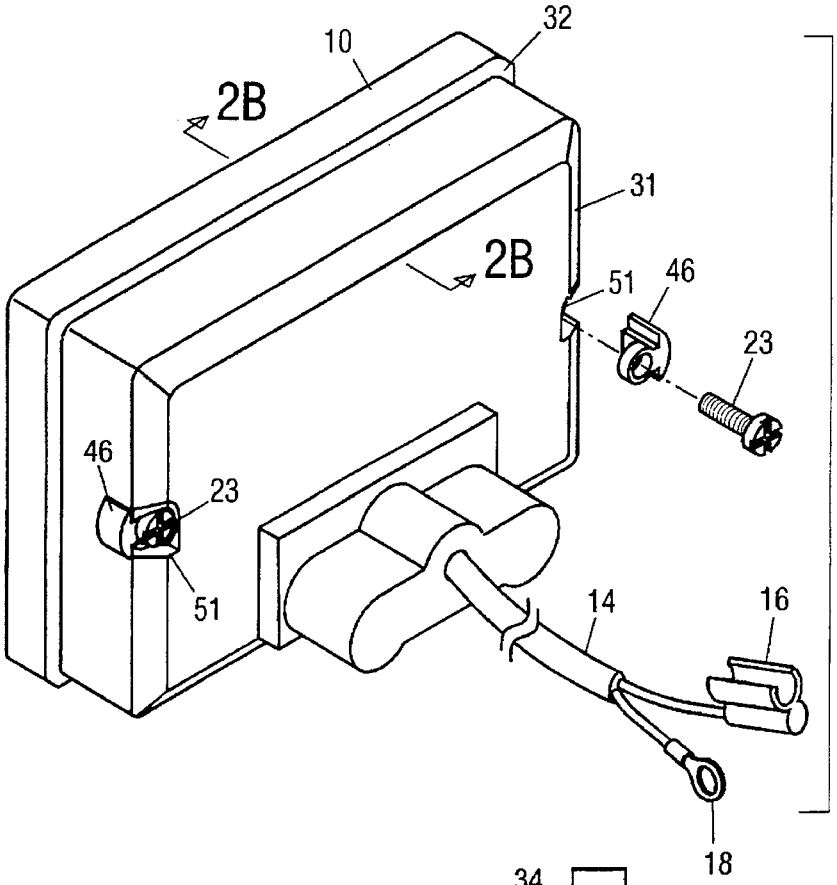
FIG. 2A is rear perspective view of the engine usage meter for instrument panel mounting in accordance with the invention.

Housing 10, which is the same as the one in FIG. 1, is shown attached to an alternative second rear housing 31 in FIG. 2A. Rear housing 31 is narrower in width and height than front housing 10, so that when they are attached together, a shoulder 32 is formed therebetween. Front and rear housings 10 and 31 also include pins 47 (FIG. 1D) and tubes 48 (FIG. 1D), respectively, attached therein. A pair of locking tabs 46 are mountable in recesses 51 on rear housing 31 with screws 23. Cable 14 is extended through the back of rear housing 31. Clip 16 is adapted to be clipped onto an ignition wire of an engine (not shown), and grounding lug 18 is adapted to be bolted to a grounded portion of the engine. When rear housing 31 is used, the electrical connection of the engine usage meter to an engine is the same as that already described in conjunction with FIG. 1.

Figure 2B:
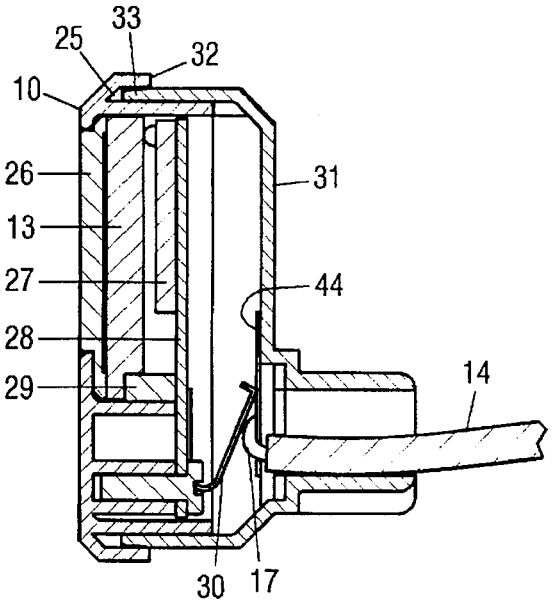
FIG. 2B is a side sectional view of the engine usage meter taken along line 2B—2B in FIG. 2A.

As shown in the side sectional view in FIG. 2B, rear housing 31 includes a rim 33 tightly fitted into groove 25 of housing 10. PCB 28 is electrically connected to cable 14 via spring contacts 30 (one shown), and a pair of solder pads 44 (one shown) arranged on the inside of rear housing 31 and soldered to wires 15 (FIG. 1A) and 17.

Figure 2C:
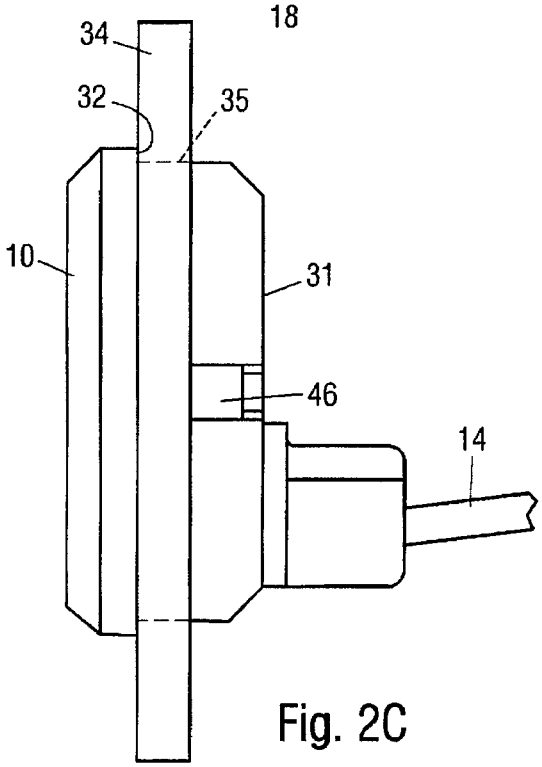
FIG. 2C is a side view of the engine usage meter of FIG. 2A mounted in an instrument panel.

The engine usage meter is installed on an instrument panel 34, such as that in a vehicle or engine test facility (not shown), by removing locking tabs 46 (one shown), pushing rear housing 31 through a cutout 35 in panel 34, and reinstalling locking tabs 46, as shown in the side view in FIG. 2C.

DESCRIPTION—FIGS. 3A AND 3B—WIRE MOUNTING

Figure 3A:
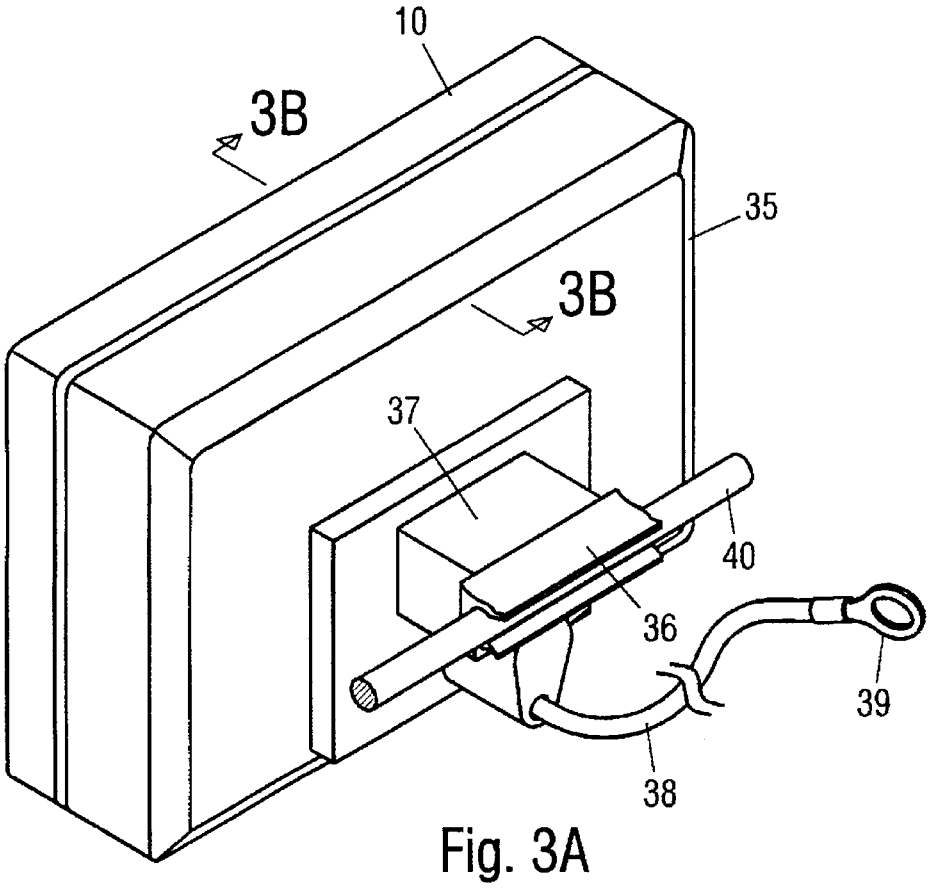
FIG. 3A is a rear perspective view of the engine usage meter for ignition wire mounting in accordance with the invention.

Housing 10, which is again the same as the one in FIG. 1, is shown attached to an alternative third rear housing 35 in FIG. 3A. Front and rear housings 10 and 35 also include pins 47 (FIG. 1D) and tubes 48 (FIG. 1D), respectively, attached therein. A combination capacitive sensor and mounting clip 36 is attached to a sleeve 37 extending from the back of rear housing 35. A ground wire 38 with a grounding lug 39 attached to a distal end thereof is positioned through the back of rear housing 35. Clip 36 is shown mounted onto an ignition wire 40 of a combustion engine (not shown), so that the entire engine usage meter is supported thereon. Lug 39 can be connected to any grounded portion of the engine. Housings 10 and 35 are made of a heat resistant material, so that the engine usage meter can be mounted close to hot engine parts without suffering any damage. In this example, the engine usage meter is only about 5.6 cm wide, 3.7 cm tall, and 1.7 cm thick, and weights only about 42 grams, so that it can be easily supported on ignition wire 40.

Figure 3B:
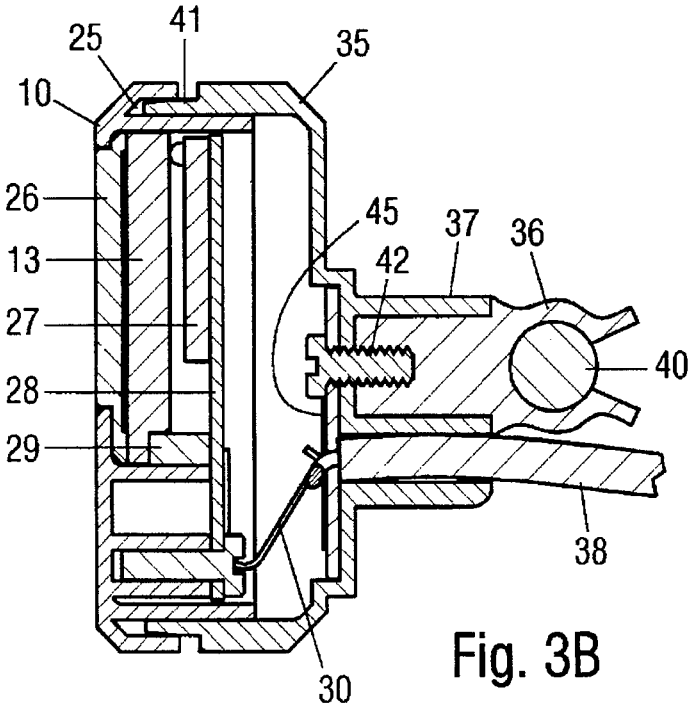
FIG. 3B is a side sectional view of the engine usage meter taken along line 3B—3B in FIG. 3A.

As shown in the side sectional view in FIG. 3B, rear housing 35 includes a rim 41 tightly fitted into groove 25 of housing 10. Clip 36 is secured within sleeve 37 with a conductive screw 42, which also electrically connects clip 36 to one of two solder pads 45 (one shown) arranged within rear housing 35. Ground wire 38 is soldered to the other solder pad (not shown). PCB 28 is electrically connected to solder pads 45 via spring contacts 30 (one shown).

CONCLUSION, RAMIFICATIONS, AND SCOPE

Accordingly, the reader will see that we have provided an engine usage meter that can be easily adapted for mounting onto either a handlebar, an instrument panel, or directly onto an ignition wire by simply using one of three interchangeable rear housings. By arranging all the electronics in the front housing, and providing several inexpensive rear housings, the engine usage meter can be economically produced and easily configured for many different applications. Furthermore, inventory cost is also minimized. When installed on a spark ignition engine, the engine usage meter will accurately monitor and display the total engine operating time, regardless of the engine's number of cylinders, strokes, type of ignition system, and without requiring any adjustment, so that engine maintenance can be performed according to schedule. When the front and rear housings are attached together, the meter is water and tamper resistant. It is also compact and lightweight, so that it can be installed anywhere, including directly on an ignition wire.

Although the above descriptions are specific, they should not be considered as limitations on the scope of the invention, but only as examples of the preferred embodiment. Many other ramifications and variations are possible within the teachings of the invention. Therefore, the scope of the invention should not be determined by the examples given, but by the appended claims and their legal equivalents.

We claim:

1. An engine usage meter for monitoring an engine having an electrical system, comprising:

a front housing, a sensor clip adapted to be clipped onto an ignition wire in said electrical system, circuit means disposed within said front housing and connected to said sensor clip via a signal wire for monitoring a total operating time of said engine, a rear housing attached to said front housing, said rear housing having a concave back portion adapted to be mounted around a front portion of a handlebar, a concave mounting bracket adapted to be positioned around a back portion of said handlebar, said concave mounting bracket having opposite ends, and a pair of screws positioned through said concave mounting bracket at said opposite ends, said screws being adapted to be positioned on opposite sides of said handlebar, said screws connecting said concave mounting bracket to said rear housing for securing said engine usage meter on said handlebar.

2. The engine usage meter of claim 1, further including a grounding wire connected to said circuit means, and adapted to be attached to a grounded portion of said electrical system.

3. The engine usage meter of claim 1, further including a display arranged on said front housing for displaying said total operating time.

4. The engine usage meter of claim 1, further including a groove surrounding said front housing for receiving a rim of said rear housing.

5. The engine usage meter of claim 1, wherein said circuit means comprises circuitry arranged on a circuit board positioned within said front housing.

6. The engine usage meter of claim 5, further including a solder pad arranged within said rear housing and soldered to said signal wire, and a spring contact soldered to said circuit board and positioned to make electrical contact with said solder pad.

7. An engine usage meter for monitoring an engine having an electrical system, comprising:

a front housing, a sensor clip adapted to be clipped onto an ignition wire in said electrical system, circuit means disposed within said front housing and connected to said sensor clip via a signal wire for monitoring a total operating time of said engine, a rear housing attached to said front housing, a shoulder arranged between said front and rear housings, said rear housing is adapted to be positioned through a cutout in an instrument panel until said shoulder engages a front side thereof, and a pair of locking tabs positioned in a pair of recesses on opposite sides of said rear housing, said locking tabs extending from said opposite sides of said rear housing and adapted to be positioned against a rear side of said instrument panel for securing said engine usage meter thereto.

8. The engine usage meter of claim 7, further including a grounding wire connected to said circuit means, and adapted to be attached to a grounded portion of said electrical system.

9. The engine usage meter of claim 7, further including a display arranged on said front housing for displaying said total operating time.

10. The engine usage meter of claim 7, further including a groove surrounding said front housing for receiving a rim of said rear housing.

11. The engine usage meter of claim 7 wherein said circuit means comprises circuitry arranged on a circuit board positioned within said front housing.

12. The engine usage meter of claim 11, further including a solder pad arranged within said rear housing and soldered to said signal wire, and a spring contact soldered to said circuit board and positioned to make electrical contact with said solder pad.

13. The engine usage meter of claim 7 wherein said front housing and said rear housing are made of a heat resistant material.

14. An engine usage meter for monitoring an engine having an electrical system, comprising:

a front housing, a circuit board arranged within said front housing for monitoring a total operating time of said engine, a sensor clip adapted to be clipped onto an ignition wire in said electrical system, a rear housing attached to said front housing, a solder pad arranged within said rear housing and connected to said sensor clip, and a spring contact electrically connecting said circuit board and said solder pad, so that said circuit board and said sensor clip are electrically connected by attaching said rear housing to said front housing.

* * * * *